US010486044B2

(12) United States Patent
Kitagawa

(10) Patent No.: US 10,486,044 B2
(45) Date of Patent: Nov. 26, 2019

(54) GOLF CLUB HEAD

(71) Applicant: Bridgestone Sports Co., Ltd., Tokyo (JP)

(72) Inventor: Tomonori Kitagawa, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 15/925,877

(22) Filed: Mar. 20, 2018

(65) Prior Publication Data

US 2018/0345106 A1 Dec. 6, 2018

(30) Foreign Application Priority Data

Jun. 5, 2017 (JP) ..... 2017-111140

(51) Int. Cl.
*A63B 53/04* (2015.01)
*A63B 60/54* (2015.01)
*A63B 60/52* (2015.01)

(52) U.S. Cl.
CPC ..... *A63B 60/54* (2015.10); *A63B 53/047* (2013.01); *A63B 53/0466* (2013.01); *A63B 60/52* (2015.10); *A63B 2053/0454* (2013.01); *A63B 2053/0479* (2013.01)

(58) Field of Classification Search
CPC .... A63B 2053/0454; A63B 2053/0491; A63B 53/0475
USPC ..... 473/245–248, 329, 350, 333
See application file for complete search history.

(56) References Cited

U.S. PATENT DOCUMENTS 4,027,885 A * 6/1977 Rogers ..... A63B 53/04 473/342
4,252,262 A 2/1981 Igarashi
4,398,965 A * 8/1983 Campau ..... A63B 53/04 148/522
5,255,918 A * 10/1993 Anderson ..... A63B 53/04 473/330
5,697,855 A * 12/1997 Aizawa ..... A63B 53/04 473/350
7,651,408 B2 * 1/2010 Hagood ..... A63B 53/047 473/329
8,376,873 B2 2/2013 Golden et al.
9,480,888 B1 11/2016 Allen
9,539,478 B2 1/2017 Narita et al.
9,731,176 B2 * 8/2017 Issertell ..... A63B 53/047
(Continued)

FOREIGN PATENT DOCUMENTS

JP 53-065128 A 6/1978
JP 55-035682 A 3/1980
(Continued)

*Primary Examiner* — Raeann Gorden
(74) *Attorney, Agent, or Firm* — Sughrue Mion, PLLC

(57) ABSTRACT

A golf club head that includes a head upper portion, a head bottom portion and a face portion between the head upper portion and the head bottom portion is provided with a slit that is open in the head upper portion on a back side of the face portion, extends in a toe-heel direction and is formed toward the head bottom portion, an intermediate member configured to be provided in the slit and abut against a first wall surface on the face portion side that defines the slit, and a fixing member configured to fix the intermediate member from a side of a second wall surface on the back side that is separated from the first wall surface and defines the slit.

10 Claims, 4 Drawing Sheets

(56) References Cited

U.S. PATENT DOCUMENTS

| | | | | |
|---|---|---|---|---|
| 9,802,089 | B2 * | 10/2017 | Honea | A63B 53/047 |
| 9,937,395 | B2 * | 4/2018 | Taylor | A63B 53/047 |
| 10,086,244 | B2 * | 10/2018 | Morin | A63B 53/047 |
| 2009/0163295 | A1 * | 6/2009 | Tseng | A63B 53/0475 473/346 |
| 2011/0250985 | A1 * | 10/2011 | Stites | A63B 53/047 473/332 |

FOREIGN PATENT DOCUMENTS

| | | | |
|---|---|---|---|
| JP | 1-126269 | U | 8/1989 |
| JP | 3046011 | U | 2/1998 |
| JP | 2006-198327 | A | 8/2006 |
| JP | 2014-111170 | A | 6/2014 |
| JP | 2015-231485 | A | 12/2015 |

* cited by examiner

GOLF CLUB HEAD

BACKGROUND OF THE INVENTION

Field of the Invention

The present invention relates to a golf club head.

Description of the Related Art

In order to control the loft of the face portion at impact and the state of friction and feel when hitting the ball, proposals such as providing a cavity behind the face portion, inserting rubber or resin into the cavity, and the like, have been made (for example, Japanese Patent Laid-Open No. 2015-231485, Japanese Patent Laid-Open No. 2014-111170, Japanese Utility Model Application Laid-Open No. 01-126269, U.S. Pat. No. 9,480,888, Japanese Patent Laid-Open No. 2006-198327, Japanese Patent Laid-Open No. 53-65128, Japanese Patent Laid-Open No. 55-35682, and Utility Model Registration No. 3046011).

When a slit that is open in a head upper portion is formed, the loft of the face portion increases at impact, enabling the launch angle of the ball to be increased. However, the front and back wall surfaces demarcating the slit can knock against each other at impact, making a strange sound. Placing an insert such as rubber or resin inside the slit is effective in remedying this problem, although this can result in the intended function not being achieved if the insert is not appropriately held within the slit.

SUMMARY OF THE INVENTION

It is an object of the present invention to be able to increase the launch angle of the ball by formation of a slit, and to hold a slit insert within the slit.

According to an aspect of the present invention, a golf club head that includes a head upper portion, a head bottom portion and a face portion between the head upper portion and the head bottom portion is provided with a slit that is open in the head upper portion on a back side of the face portion, extends in a toe-heel direction, and is formed toward the head bottom portion, an intermediate member configured to be provided in the slit, and abut against a first wall surface on the face portion side that defines the slit, and a fixing member configured to fix the intermediate member from a side of a second wall surface on the back side that is separated from the first wall surface and defines the slit.

Further features of the present invention will become apparent from the following description of exemplary embodiments (with reference to the attached drawings).

DESCRIPTION OF THE EMBODIMENTS

Figure 1A:
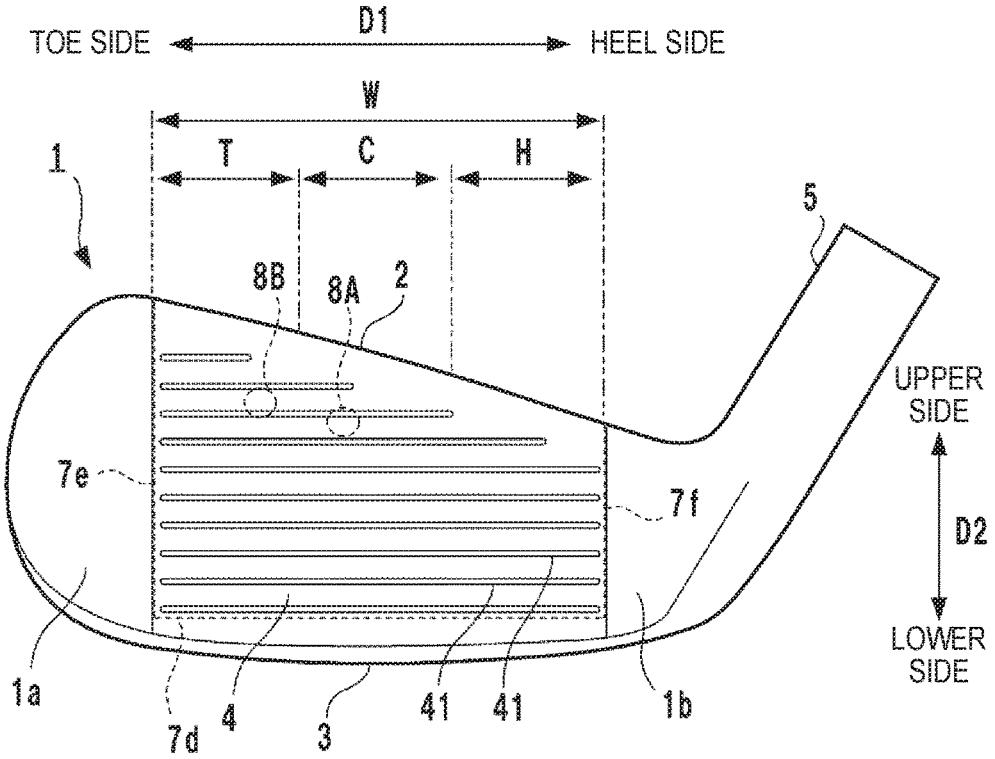
FIG. 1A is a front view of a golf club head of an embodiment.
Figure 1B:
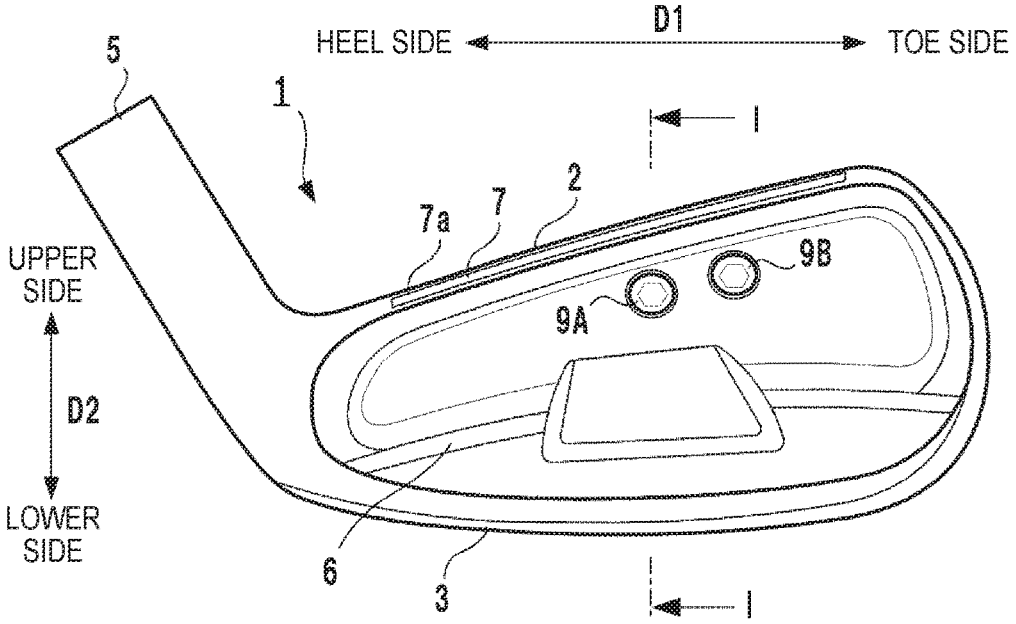
FIG. 1B is a back view.
Figure 2A:
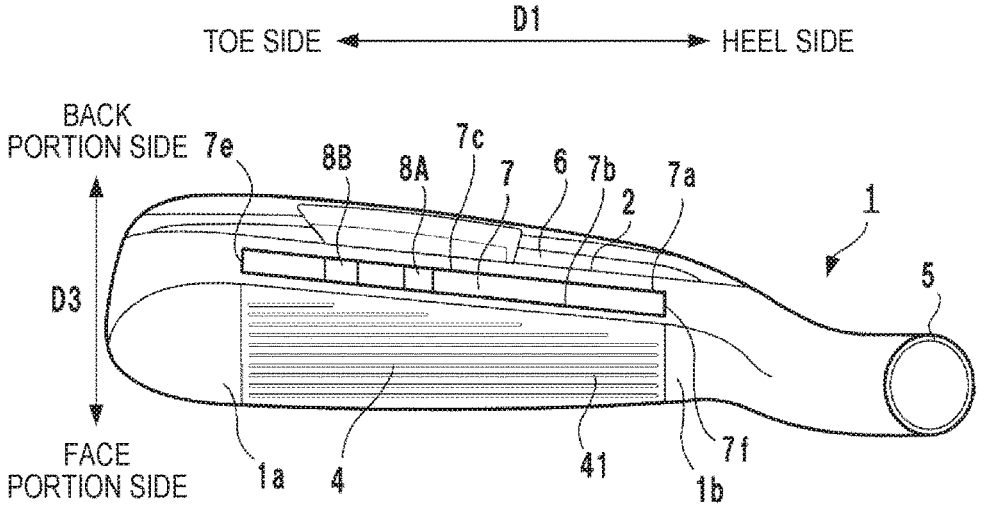
FIG. 2A is a plan view of the golf club head of FIG. 1A.
Figure 2B:
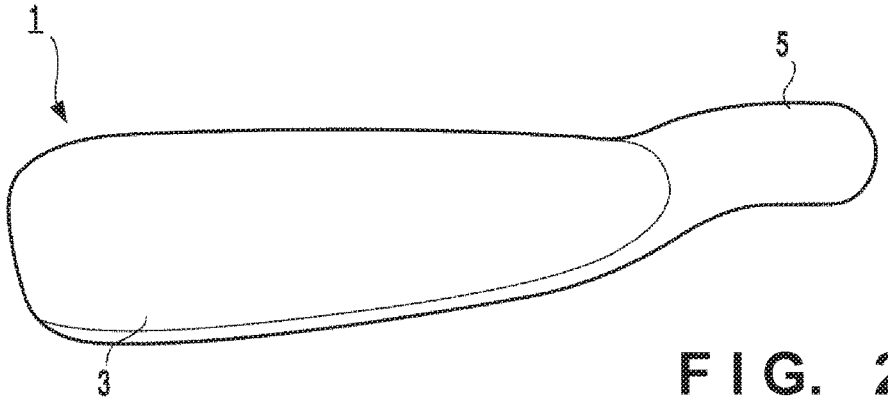
FIG. 2B is a bottom view.
Figure 2C:
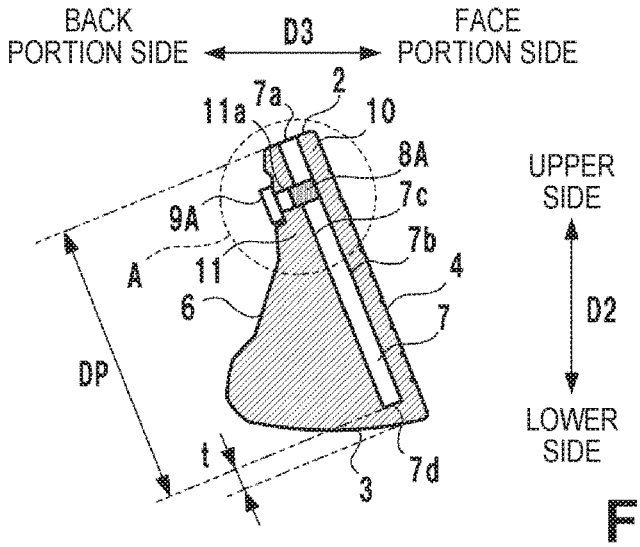
FIG. 2C is a cross-sectional view along a line I-I in FIG. 1B.
Figure 3A:
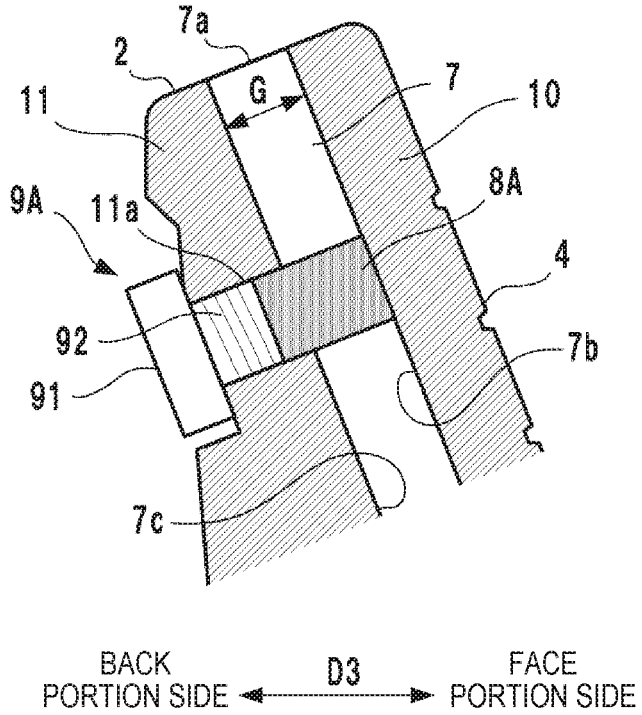
FIG. 3A is an enlarged view of an A section of FIG. 2C.
Figure 3B:
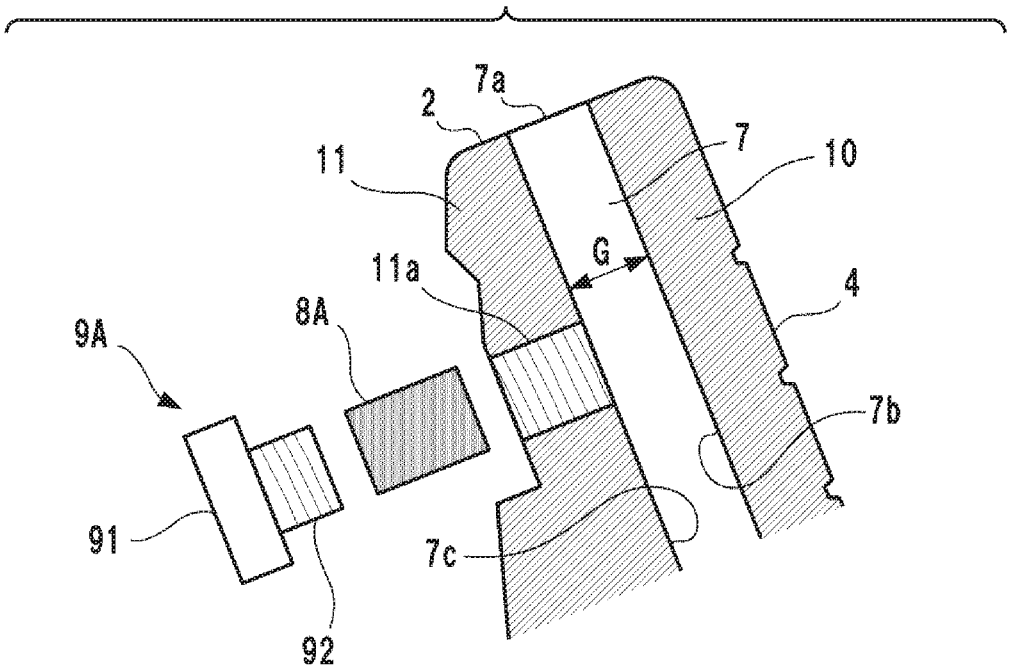
FIG. 3B is an exploded view.

A golf club head 1 according to one embodiment of the present invention will be described with reference to FIGS. 1A to 3B. FIG. 1A is a front view of the golf club head 1, FIG. 1B a back view, FIG. 2A is a plan view, FIG. 2B is a bottom view, FIG. 2C is cross-sectional view along a line I-I in FIG. 1B. FIG. 3A is an enlarged view of an A section in FIG. 2C, and FIG. 3B is an exploded view. In the drawings, an arrow D1 indicates a toe-heel direction, an arrow D2 indicates an up-down direction, and an arrow D3 indicates a face-back direction.

The golf club head 1 is an iron-type golf club head. Although the present invention is applicable to any of a long iron, a middle iron, a short iron and a wedge, a long iron and a middle iron are suitable in terms of increasing the launch angle. The present invention is applicable not only to an iron-type golf club head but also to a utility type (hybrid-type) and a wood-type golf club head.

The golf club head 1 includes a head upper portion 2, a head bottom portion 3, a face portion 4, a hosel portion 5, and a back portion 6. The head upper portion 2 forms an upper surface of the golf club head 1, and the head bottom portion 3 is a sole portion and forms a bottom surface of the golf club head 1. A head front surface portion between the head upper portion 2 and the head bottom portion 3 includes a toe-side portion 1*a*, a heel-side portion 1*b*, and the face portion 4 between the toe-side portion 1*a* and the heel-side portion 1*b*. The face portion 4 forms the surface that strikes the golf ball. In the case of the present embodiment, the face portion 4 forms a flat striking face, and a plurality of score lines 41 extending in the D1 direction are formed in the D2 direction. The face portion 4, the toe-side portion 1*a* and the heel-side portion 1*b* can be distinguished by, for example, whether or not the area has score lines 41 formed therein such as in the present embodiment or whether the area has undergone a different surface treatment.

As surface treatments, blasting and the like are performed on the face portion 4, and plating, polish finishing and the like are performed on the toe-side portion 1*a* and the heel-side portion 1*b*, for example. The back portion 6 forms the back surface of the golf club head 1. The face portion 4 and the back portion 6 are located between the head upper portion 2 and the head bottom portion 3.

The head upper portion 2, the head bottom portion 3, the face portion 4, the hosel portion 5 and the back portion 6 are formed as a single component of a metal material. However, it is also possible to form these portions with two components consisting of a face member that includes the face portion 4 and a main body member that includes the head upper portion 2, the head bottom portion 3, the hosel portion 5 and the back portion 6.

The golf club head 1 includes a slit 7. The slit 7 includes an opening 7*a* that is open in the head upper portion 2 on the back portion 6 side of the face portion 4, and is formed toward the head bottom portion 3 along the face portion 4 from the opening 7*a*. In the case of the present embodiment, the slit 7 is formed parallel to the face portion 4 in both the D1 direction and the D3 direction, but may be formed along the face portion 4 at an angle to the face portion 4.

The slit 7 is a thin plate-shaped space forming a gap in the D3 direction, and the ends in the D3 direction are defined by a wall surface (first wall surface) 7*b* on the face portion 4 side and a wall surface (second wall surface) 7*c* on the back portion 6 side. When the golf club head 1 is partitioned in the D3 direction along the slit 7, the wall surface 7*b* is formed by a solid portion 10 that includes the face portion 4, and the wall surface 7*c* is formed by a solid portion 11 that includes the back portion 6. The portion 10 and the portion 11 are connected on the toe side, the heel side and the head bottom portion 3 side.

The wall surface 7*b* and the wall surface 7*c* are formed parallel to and opposing each other, and an interval G (gap of the slit 7) therebetween is, for example, from 1 mm to 4 mm inclusive.

The slit 7 is a bottomed space in which the end on the head bottom portion 3 side is defined by a bottom wall surface 7*d*. A depth DP from the opening 7*a* to the bottom wall surface 7*d* is, for example, from 25 mm to 50 mm inclusive. Also, the position of the bottom wall surface 7*d* in the D2 direction is preferably a position on the head bottom portion 3 side of a face center, and may, for example, be the same position as or a lower position than the score line 41 furthest on the head bottom portion 3 side, among the plurality of score lines 41 on the face portion 4. In the case of the present embodiment, the bottom wall surface 7*d* is located in a lower position than the score line 41 furthest on the head bottom portion 3 side. Also, a shortest distance t from the bottom wall surface 7*d* to the head bottom portion 3 is, for example, from 1 mm to 5 mm inclusive.

Figure 4:
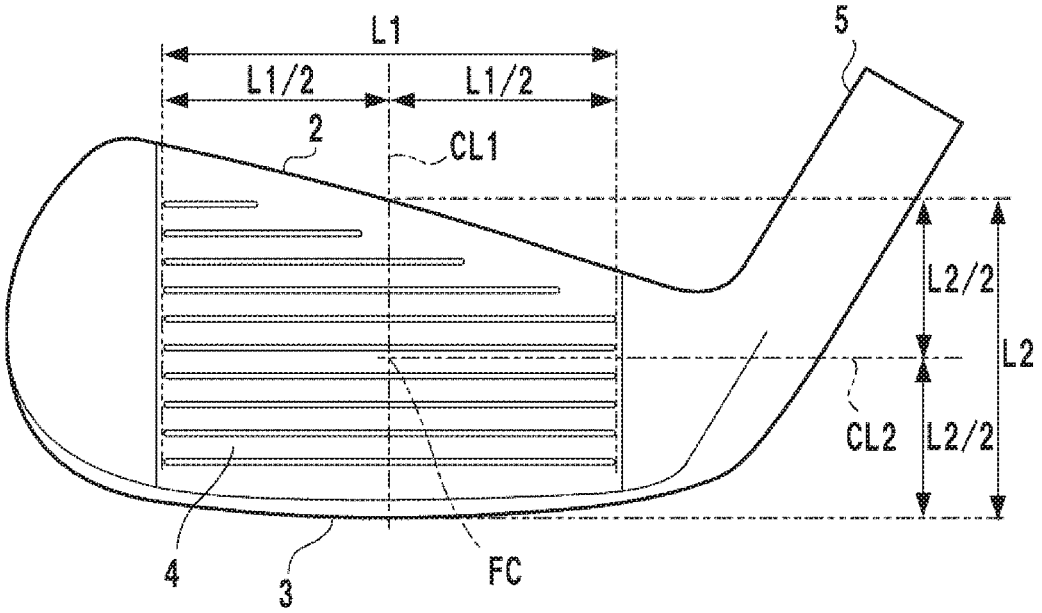
FIG. 4 is an illustrative view of a face center.

Here, the face center in the present embodiment will be described with reference to FIG. 4. A state where the golf club head 1 is placed on the ground at prescribed lie and loft angles is taken as a reference. The length of the longest score line in the toe-heel direction is given as L1, and an imaginary plane passing through a middle position of this length is given as CL1. The height from the ground surface to the head upper portion 2 on the imaginary plane CL1 is given as L2, and an imaginary plane passing through a middle position of this height is given as CL2. A point of intersection FC between the face portion 4 and the line of intersection of the imaginary plane CL1 and the imaginary plane CL2 is the face center.

The slit 7 runs in the D1 direction, and the end on the toe side and the end on the heel side are respectively defined by a wall surface 7*e* and a wall surface 7*f*. In the case of the present embodiment, the wall surface 7*e* and the wall surface 7*f* extend parallel to each other in the D2 direction. A spacing W between the wall surface 7*e* and the wall surface 7*f* is, for example, from 45 mm to 60 mm inclusive. Also, the positions of the wall surface 7*e* and the wall surface 7*f* in the D1 direction may, for example, be the same as or on the outer side of the positions of the ends of the face portion 4 in the D1 direction. In the case of the present embodiment, the positions of the wall surface 7*e* and the wall surface 7*f* in the D1 direction are the same positions as the positions of the ends of the face portion 4 in the D1 direction.

Providing such a slit 7 facilitates the backward tilting of the face portion 4 (portion 10) to the back portion 6 side at the time of striking the golf ball. In other words, the loft angle of the face portion 4 increases. The launch angle of the ball can thus be increased.

At the time of the face portion 4 tilting backward at impact, the gap of the slit 7 narrows, and interference can occur between the wall surface 7*b* and the wall surface 7*c*. In order to prevent this, in the present embodiment, intermediate members 8A and 8B (hereinafter, referred to as intermediate members 8, in the case of not distinguishing therebetween) are provided in the slit 7. The intermediate members 8 are made of a resin, a fiber-reinforced resin, a rubber, a metal, or the like, for example. The intermediate members 8 abut against the wall surface 7*b*, and regulate interference between the wall surface 7*b* and the wall surface 7*c*.

Although one or a plurality of intermediate members may be disposed in the slit 7 so as to fill the entirety of the slit 7, the intermediate members 8 of the present embodiment are disposed in only a partial region thereof (two places). Backward tilting of the face portion 4 is thereby facilitated at impact.

Also, the face portion 4 (portion 10) has a tendency to be readily deformable on the toe side when viewed in the D1 direction. The heel side is relatively less deformable due to having a narrow width in the D2 direction and also because of the hosel portion 5. When the face portion 4 is divided equally in the D1 direction into three portions consisting of a toe side portion T, a middle portion C and a heel side portion H as shown in FIG. 1A, the intermediate members 8 are preferably provided in the toe side portion T or the middle portion C, from the viewpoint of preventing interference between the wall surface 7*b* and the wall surface 7*c*. In the case of the present embodiment, the intermediate member 8A is disposed in the middle portion C and the intermediate member 8B is disposed in the toe side portion T.

Also, the face portion 4 (portion 10) has a tendency to be readily deformable on the head upper portion 2 side when viewed in the D2 direction. This is because the slit 7 is bottomed and open in the head upper portion 2. From the viewpoint of preventing interference between the wall surface 7*b* and the wall surface 7*c*, the intermediate members 8 are preferably located on the head upper portion 2 side of the face center in the D2 direction, and the intermediate members 8A and 8B of the present embodiment are both located on the head upper portion 2 side of the face center. Furthermore, the intermediate member 8B is located on the head upper portion 2 side of the intermediate member 8A, in correspondence with the outline shape of the upper face portion side 4, and the capacity to prevent interference between the wall surface 7*b* and the wall surface 7*c* is improved by a small number of intermediate members 8 that are small in area.

Given that the gap of the slit 7 changes at impact, it is necessary to prevent dropping out of the intermediate members 8 from the slit 7 and changing of the position of the intermediate members 8. In the present embodiment, the intermediate members 8A and 8B are respectively fixed by fixing members 9A and 9B (hereinafter, referred to as fixing members 9, in the case of not distinguishing therebetween). In the case of the present embodiment, the fixing members 9A and 9B have the same configuration, and the intermediate members 8A and 8B have the same configuration.

Although the structure of the set of the intermediate member 8A and the fixing member 9A will be described with reference to FIGS. 3A and 3B, the structure of the set of the intermediate member 8B and the fixing member 9B is similar.

In the case of the present embodiment, the fixing member 9A is a member that engages a hole 11*a* formed in the portion 11. The mode of engagement may be any of press fitting, adhesion, welding and the like, and in the present embodiment a threaded structure is provided in terms of removability. The fixing member 9A is a threaded member that includes a head 91 and a threaded portion 92, and the hole 11*a* is a threaded hole.

The hole 11*a* is a through hole that passes through the portion 11 in the D3 direction and is open in the wall surface 7*c*. The intermediate member 8A is a columnar member, and has a diameter that enables insertion into the hole 11*a*. As shown in FIG. 3A, the end of the intermediate member 8A on the face portion 4 side abuts against the wall surface 7*b*, and the end thereof on the back portion 6 side is partially inserted into the hole 11*a*. Such a configuration of the present embodiment is advantageous in terms of assemblability, replaceability and dropout prevention.

After inserting the intermediate member 8A into the hole 11*a*, the fixing member 9A is screwed into the hole 11*a*. The tip of the threaded portion 92 pushes in the intermediate member 8A, and the intermediate member 8A abuts against the wall surface 7*b*. The intermediate member 8A may be compressed between the wall surface 7*b* and the fixing member 9A.

As described above, according to the golf club head 1 of the present embodiment, the launch angle of the ball can be increased by formation of the slit 7, and the intermediate members 8 which are inserts of the slit 7 can be held within the slit 7 by the fixing members 9.

Note that although there are two sets of intermediate members 8 and fixing members 9 in the present embodiment, there may one set or more than three sets.

Also, the intermediate members 8 may be provided integrally with the fixing members 9 by adhesion or the like. For example, the end face of the intermediate members 8 on the back portion 6 side may be adhered to the tip face of the threaded portion 92.

Alternatively, the tip of the threaded portion 92 may be provided with a wedge-shaped engaging portion that projects from the tip, and the threaded portion 92 may be integrated with the intermediate member 8 by piercing the engaging portion into the end of the intermediate member 8 on the back portion 6 side. The attachability and replaceability of the intermediate members 8 and the fixing members 9 can thereby be further improved.

The extent of the backward tilting of the face portion 4 at impact can be controlled by the elastic deformation characteristics of the intermediate members 8. For example, a hard material that deforms a small amount is suitable for the intermediate members 8 with respect to a hard hitter. Conversely, a soft material that deforms a large amount is suitable for the intermediate members 8 with respect to a comparatively less powerful golfer. In view of this, the intermediate members 8 are selectable from a plurality of types of intermediate members. In the present embodiment, it is also possible for the golfer to select intermediate members 8 of a type that suits his or her preference, since the intermediate members 8 and the fixing members 9 are configured to be removable from the head. Also, in the case where there are a plurality of sets of intermediate members 8 and fixing members 9, as in the present embodiment, there may be sets with different types of intermediate member 8, and the golfer can also select the types of intermediate members 8 in this case.

Also, in order to prevent foreign matter from getting into the slit 7, the opening 7*a* may be provided with a cover.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefits of Japanese Patent Application No. 2017-111140, filed Jun. 5, 2017, which is hereby incorporated by reference herein in its entirety.

What is claimed is:

1. A golf club head that includes a head upper portion, a head bottom portion and a face portion between the head upper portion and the head bottom portion, comprising:

a slit that is open in the head upper portion on a back side of the face portion, extends in a toe-heel direction, and is formed toward the head bottom portion, a bottom end, a toe side end and a heel side end of the slit being closed;

a bottom wall surface;

an intermediate member configured to be provided in the slit, and abut against a first wall surface on the face portion side that defines the slit; and a fixing member configured to fix the intermediate member from a side of a second wall surface on the back side that is separated from the first wall surface and defines the slit.

2. The golf club head according to claim 1, wherein the intermediate member is made of a resin, a fiber-reinforced resin, a rubber or a metal.

3. The golf club head according to claim 1, comprising:

a first portion that includes the face portion and the first wall surface;

a second portion that is located on the back side relative to the first portion across the slit, and includes the second wall surface, wherein the second portion includes a hole that passes through the second portion in a face-back direction, and is open in the second wall surface, the intermediate member includes a part that is inserted into the hole, and the fixing member is attached to the hole.

4. The golf club head according to claim 1, wherein, in a case where the face portion is equally divided into three portions consisting of a toe side portion, a middle portion and a heel side portion in the toe-heel direction, the intermediate member and the fixing member are located in the toe side portion or the middle portion.

5. The golf club head according to claim 1, wherein the intermediate member and the fixing member are removable, and the intermediate member is selectable from a plurality of types of intermediate members.

6. The golf club head according to claim 1, comprising:

the bottom wall surface that defines the bottom end of the slit, wherein the bottom wall surface is located on the head bottom portion side.

7. The golf club head according to claim 1, comprising:

a toe side wall surface that defines the toe side end of the slit; and a heel side wall surface that defines the heel side end of the slit.

8. The golf club head according to claim 7, wherein the toe side wall surface and the heel side wall surface are parallel with each other.

9. The golf club head according to claim 8, wherein a spacing between the toe side wall surface and the heel side wall surface is from 45 mm to 60 mm inclusive.

10. The golf club head according to claim 6, wherein a depth of the slit from an opening portion in the head upper portion to the bottom wall surface is from 25 mm to 50 mm inclusive.

* * * * *